United States Patent [19]

Adams et al.

[11] Patent Number: 4,828,200

[45] Date of Patent: May 9, 1989

[54] YARN CARRIER TUBE WITH UNIVERSAL YARN CATCHING MEANS

[75] Inventors: Samuel F. Adams; Hans-Peter Bolz, both of Greenville, S.C.

[73] Assignee: Sonoco Products Company, Hartsville, S.C.

[21] Appl. No.: 221,106

[22] Filed: Jul. 19, 1988

[51] Int. Cl.[4] ..... B65H 75/26; B65H 75/28

[52] U.S. Cl. ..... 242/118.3; 242/18 R; 242/18 PW; 242/118.32; 242/125.1

[58] Field of Search ..... 242/118.3, 118.31, 118.32, 242/125, 125.1, 18 R, 18 PW, 118.1, 118.11

[56] References Cited

U.S. PATENT DOCUMENTS 3,887,145 6/1975 Egyptien et al. ..... 242/125.1
3,955,775 5/1976 Egyptien et al. ..... 242/125.1
4,050,645 9/1977 Burchette, Jr. et al. ..... 242/125.1
4,050,646 9/1977 Burchette, Jr. ..... 242/125.1

*Primary Examiner*—Stanley N. Gilreath
*Attorney, Agent, or Firm*—Bell, Seltzer, Park & Gibson

[57] ABSTRACT

A universal yarn carrier is disclosed which is adapted to have an advancing yarn effectively wound thereon, when used on either a P-wind or a Q-wind machine. The yarn carrier comprises a molded plastic tube having an external cylindrical surface, and at least one yarn catching means integrally formed on the exterior surface adjacent one end thereof. The yarn catching means is adapted to catch and anchor one or more of the initial yarn windings so as to prevent axial slippage thereof, and the yarn catching means comprises an annular depression, and an extension extending in the longitudinal direction across a portion of the depression so as to define a tip at the free end of the extension for engaging the yarn being wound upon the carrier.

8 Claims, 2 Drawing Sheets

P-WIND

Q-WIND

YARN CARRIER TUBE WITH UNIVERSAL YARN CATCHING MEANS

FIELD OF THE INVENTION

The present invention relates to a yarn carrier adapted to be mounted on a winding machine and to have a yarn spirally wound thereon to form a yarn package, and which incorporates a universal yarn catching means which is effective with a winding machine of either the P-wind or the Q-wind type.

BACKGROUND OF THE INVENTION

Tubular yarn carriers are commonly employed in the textile industry to support a quantity of yarn in package form, and so that the yarn may be processed in package form or simply transported between various manufacturing operations. The yarn is commonly wound on the tube by an automatic winding machine, wherein the tubes are mounted and held between conical holders of the machine, which impart rotation to the tube. Also, the machine includes a yarn traversing device whereby the advancing yarn is traversed in a back and forth pattern so as to form spiral windings on the tube.

A well recognized problem associated with winding operations of the described type is the fact that the initial windings on the tube tend to slip toward the longitudinal center of the tube, thus defeating the desired uniformity of the wind. To avoid this problem, it is common practice to initially clamp the leading end of the yarn to be wound between one end of the tube and the associated conical holder of the winding machine, which serves to anchor the windings at that end of the carrier. To anchor the windings at the other end, it is common practice to form an integral yarn catching device adjacent the other end which is designed to engage and anchor the windings. However, winding machines are of two conventional types, commonly referred to as the P-wind machine and the Q-wind machine. In the P-wind machine, the yarn leading end is anchored at the right end of the carrier as viewed by the operator, and the carrier is oriented so that the yarn catching device is on the left end of the carrier. In the Q-wind machine, the yarn leading end is anchored at the left end, and the carrier is oriented with the yarn catching device on the right end. Also, the known yarn catching devices are not universal, in that they are able to provide effective yarn catching upon winding, and non-snag release upon unwinding, for only the P-wind machine, or the Q-wind machine, but not both. Thus it has been conventional to fabricate the yarn carriers with yarn catching devices which are designed for use with only P-wind machine, or only with Q-wind machines, and as a result, carriers having two different designs of the yarn catching devices were required to be manufactured, and then inventoried by the users of the carriers.

It is accordingly an object of the present invention to provide a yarn carrier which incorporates a universal yarn catching means, and which is able to effectively catch the yarn when the carrier is mounted on either a P-wind machine or a Q-wind machine.

It is also an object of the present invention to provide a yarn carrier of the described type, which not only effectively catches the yarn, but also permits the snag free removal of the yarn from the carrier in either direction of rotation.

SUMMARY OF THE PRESENT INVENTION

These and other objects and advantages of the present invention are achieved in the embodiment illustrated herein by the provision of a yarn carrier which comprises a tube and yarn catching means mounted on the exterior surface of the tube adjacent one end thereof, with the yarn catching means being adapted for catching one or more of the initial windings of the yarn being spirally wound upon the exterior surface, and so as to prevent the windings from moving axially along the tube toward the other end thereof. In accordance with the present invention, the yarn catching means comprises an annular depression formed in the exterior surface of the tube so as to define a generally flat circular base surface and a circular outer wall surrounding the base surface. Also, an extension is positioned within the depression and overlying the base surface, with the extension extending longitudinally from the outer wall and in a direction toward said one end of the tube. The extension is further defined by an upper edge which is generally aligned with the exterior surface of the tube when viewed in longitudinal cross-section, and parallel opposite sides which extend in the longitudinal direction. Also, the extension includes a forward end positioned substantially coincident with the center of the circular base surface. Preferably, the parallel opposite sides are laterally spaced apart a substantially uniform distance along the longitudinal length of the extension, with the separation of the opposite sides being not more than about 0.2 of the diameter of the circular base surface.

The yarn catching means of the above disclosed configuration has been found to effectively engage and anchor the spiral windings, when the carrier is used on either a P-wind or a Q-wind machine, and in addition, the windings may be unwound without risk of snagging on the yarn catching means.

DETAILED DESCRIPTION OF THE PREFERRED EMBODIMENT

Figure 1:
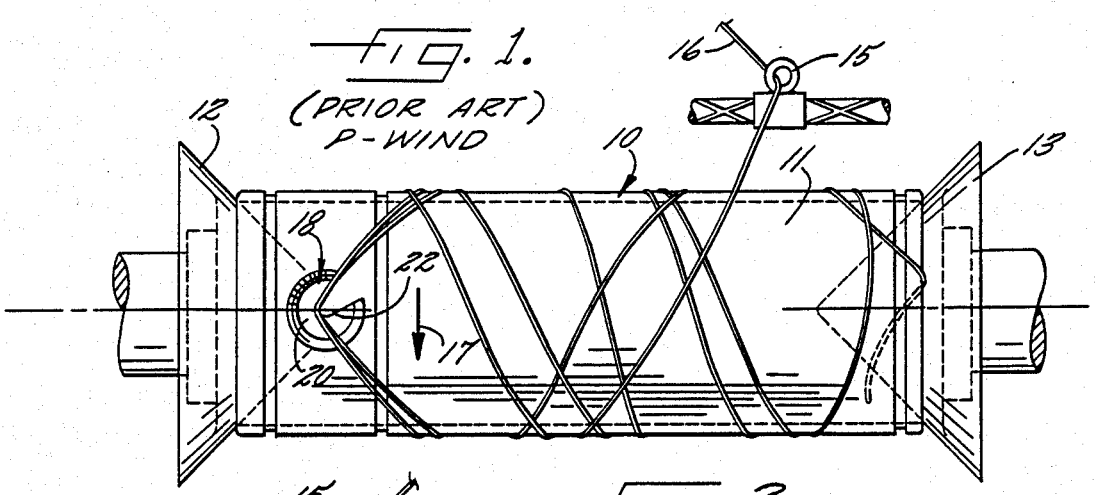
FIG. 1. (PRIOR ART)
FIG. 1 is a side elevation view of a yarn carrier and a portion of the winding machine of the P-wind type, and with the yarn carrier incorporating a yarn catching device in accordance with the prior art.

Referring more particularly to the drawings, FIG. 1 illustrates a yarn carrier 10 which incorporates a yarn catching device in accordance with the prior art. More particularly, the carrier 10 comprises a tube 11 of cylindrical construction, and which is molded from a suitable plastic material. The tube 11 as illustrated is mounted on a winding machine of the P-wind type and which includes a pair of coaxially aligned, conical holders 12, 13 which engage the opposite ends of the tube. Also, a yarn traversing device 15 is schematically illustrated, which serves to traverse the advancing yarn 16 back and forth along the longitudinal length of the tube, to thereby form spiral windings when the tube is rotated.

As illustrated by the arrow 17 in FIG. 1, the winding machine rotates the tube 11 in the clockwise direction when viewed from the left end, and the tube includes a pair of integrally formed yarn catching devices 18 adjacent the left end, with one of the devices 18 being seen in FIG. 1 and the other being circumferentially spaced 180° therefrom and being of like construction. At the beginning of the winding operation, the leading end of the yarn is initially clamped between the right end of the tube and the holder 13 of the machine, and the machine is then started so as to rotate the tube in the indicated direction and traverse the yarn. The yarn catching devices 18 serve to catch and anchor the initial windings at the left end of the tube, and so as to prevent the axial slippage of the windings toward the center of the tube. Once a few windings are in position, they serve to hold the overlying windings without being caught by the devices 18.

Figure 2:
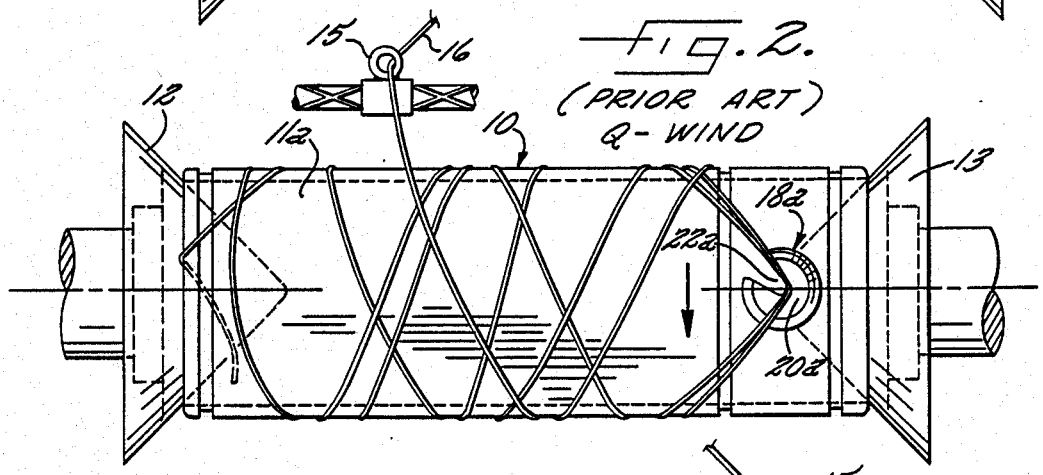
FIG. 2. (PRIOR ART)
FIG. 2 is a view similar to FIG. 1, but illustrating a winding machine of the Q-wind type and an associated yarn carrier for the Q-wind machine in accordance with the prior art.

Each yarn catching device 18 includes a depression in the exterior surface of the tube, which defines a flat circular surface 20, together with a generally triangular extension 22 which extends from about the two o'clock position of the surface 20 to the center of the depression. The yarn catching devices of this configuration has been found to effectively catch the yarn when the tube is oriented with the devices at the left end and the tube is rotated in the clockwise direction as illustrated, which is the orientation used on the P-wind machine. However, the devices 18 are not effective when the tube 11 is mounted on a Q-wind machine as illustrated in FIG. 2. In this latter case, a different tube **11*a* having a pair of yarn catching devices 18*a* of different design are conventionally employed. Specifically, the orientation of the extension 22*a* of the device 18*a*** is modified so as to extend outwardly from about the ten o'clock position of the depression, which has been found to be effective for use with a Q-wind machine but not with a P-wind machine. Thus carriers of two different designs were required to be manufactured, and inventoried by the users of the carriers, in order to be able to service all winding machines.

Figure 3:
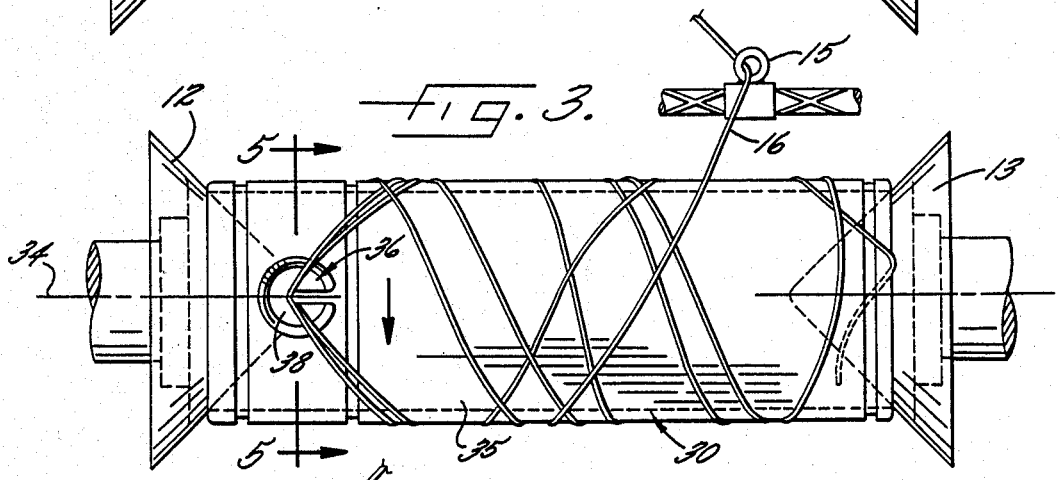
FIG. 3 is a view similar to FIG. 1, but illustrating the yarn carrier and the universal yarn catching means of the present invention.
Figure 4:
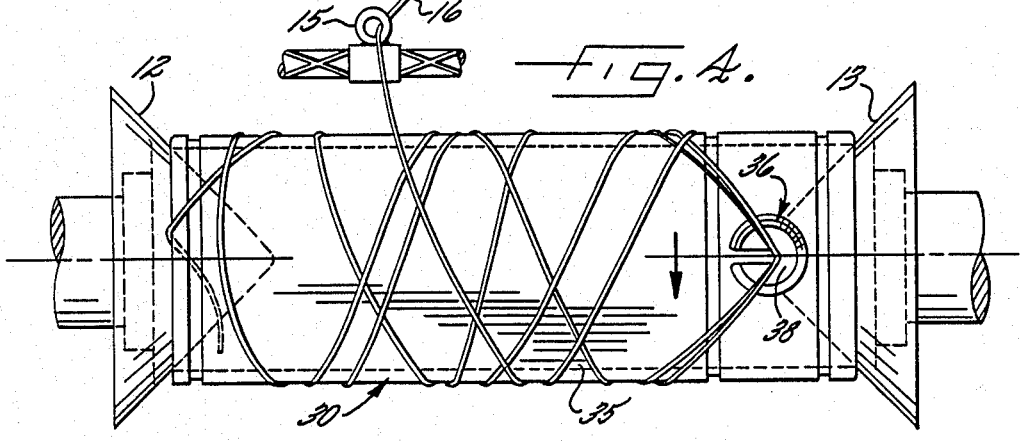
FIG. 4 is a view similar to FIG. 2, and illustrating the yarn carrier and yarn catching means of the present invention.

FIGS. 3 and 4 illustrate a yarn carrier 30 which incorporates the yarn catching means of the present invention, with FIG. 3 illustrating the use of the carrier 30 on a machine of the P-wind type, and with FIG. 4 illustrating the carrier 30 on a machine of the Q-wind type.

Figure 5:
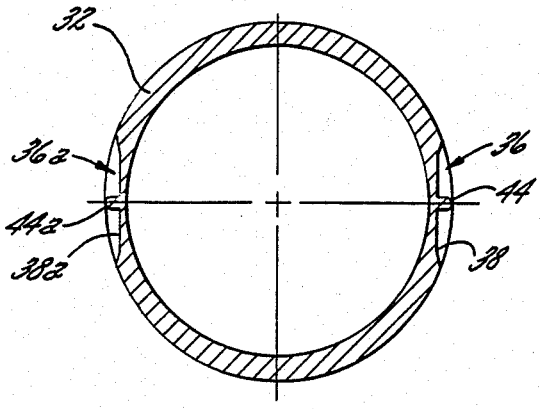
FIG. 5 is a sectional view taken substantially along the line 5—5 of FIG. 3.
Figure 6:
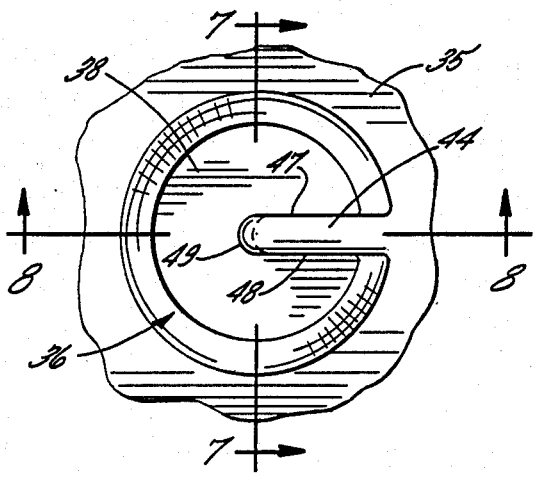
FIG. 6 is an enlarged fragmentary elevation view of the yarn catching means of the present invention.
Figure 7:
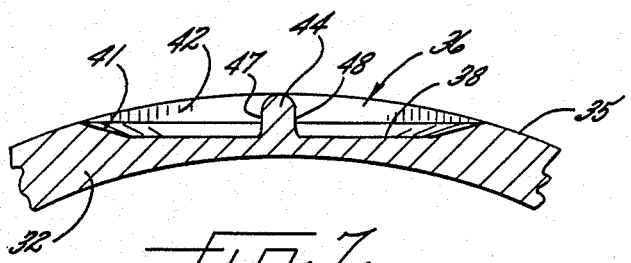
FIGS. 7 and 8 are sectional views taken respectively along the lines 7—7 and 8—8 of FIG. 6.
Figure 8:
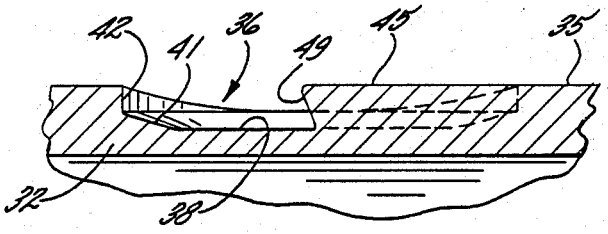

The carrier 30 is composed of a molded plastic material, and comprises a cylindrical tube 32 defining a central axis 34, an exterior cylindrical surface 35, and a longitudinal direction extending parallel to the central axis. A first yarn catching means 36 is integrally formed at the left end of the tube as illustrated in FIG. 3, and a second yarn catching means **36*a* of like construction is integrally formed on the exterior surface of the tube at a location circumferentially spaced from the first yarn catching means by 180°, and as seen in FIG. 5. Each yarn catching means 36, 36*a* comprises an annular depression formed in the exterior surface 35 so as to define a generally flat circular base surface 38 and a circular outer wall surrounding the base surface. The circular outer wall preferably is composed of an inclined wall portion 41 and an upstanding wall portion 42, with the inclined wall portion 41 serving to facilitate removal from the mold. An extension 44 is positioned within the depression and overlies the base surface 38. The extension 44 extends longitudinally from the outer wall at about the three o'clock position and toward the left end of the tube, and the extension includes an upper edge 45 which is generally coextensive with the exterior surface 35 of the tube when viewed in longitudinal cross-section, note FIG. 8. Also, the extension 44 includes opposite sides 47, 48 which extend in the longitudinal direction, and a tip or forward end 49 which is positioned substantially coincident with the center of the circular flat surface 38. Preferably, the parallel opposite sides 47, 48 are laterally spaced apart a substantially uniform distance along the length of the extension, with the separation of the opposite sides being not more than about 0.2 of the diameter of the flat circular base surface 38. Also, the forward end 49 of the extension is slightly undercut as best seen in FIG. 8**.

To describe one specific example of the carrier 30 of the present invention in more detail, the tube 32 has an axial length of 17 cm, and the exterior cylindrical surface 35 has a diameter of between about 6 to 7 cm. The base surface 38 of each yarn catching means has a diameter of between 1.5 to 1.8 cm, and the extension 44 has a length of about 1 cm. Also, the lateral spacing between the parallel opposite sides 47, 48 of the extension is about 0.2 cm.

In using the carrier 30 on a winding machine of the P-wind type, the leading end of the yarn 16 is initially clamped between the right end of the tube and the conical holder 13 of the machine, and the machine is then started so as to rotate the tube and traverse the yarn. The winding machine is designed to rotate the carrier in the clockwise direction when viewed from the left end, and the yarn catching means **36, 36*a* of the present invention is able to effectively catch and anchor one or more of the initial yarn windings at the left end of the tube. Also, it has been found that the yarn may be subsequently unwound from the tube in the clockwise direction, without the risk of snags on the yarn catching means 36, 36*a***.

FIG. 4 shows the same carrier 30 mounted on a machine of the Q-wind type, and wherein the leading end of the yarn 16 is anchored at the left end of the carrier and the carrier is oriented so that the yarn catching means **36, 36*a*** is at the right end. Here again, the yarn catching means has been found to be able to effectively catch the initial windings of the yarn and to permit the yarn to be unwound from the tube in the counterclockwise direction without snagging.

In the drawings and specification, there has been set forth a preferred embodiment of the invention, and although specific terms are employed, they are used in a generic and descriptive sense only and not for purposes of limitation.

That which is claimed is:

1. A yarn carrier adapted to be mounted on a winding machine and have an advancing yarn spirally wound thereon to form a yarn package, and comprising a tube having an exterior surface and defining a central axis and a longitudinal direction extending parallel to said central axis, and yarn catching means mounted on said exterior surface adjacent one end of said tube for catching one or more of the initial windings of a yarn being spirally wound upon the exterior surface of the tube, and so as to prevent the windings from moving axially along the tube toward the other end thereof, said yarn catching means comprising (a) an annular depression formed in said exterior surface so as to define a generally flat circular base surface and a circular outer wall surrounding said base surface, and (b) an extension positioned within said depression and overlying said base surface, with said extension extending longitudinally from said outer wall toward said one end of said tube, and with said extension including an upper edge which is generally aligned with said exterior surface of said tube when viewed in longitudinal cross-section, parallel opposite sides which extend in said longitudinal direction, and a forward end positioned substantially coincident with the center of said flat circular base surface.

2. The yarn carrier as defined in claim 1 wherein said parallel opposite sides of said extension are laterally spaced apart a substantially uniform distance along the longitudinal length of said extension, with the separation of said opposite sides being not more than about 0.2 of the diameter of said circular base surface.

3. The yarn carrier as defined in claim 2 wherein said forward end of said extension is slightly undercut with respect to said upper edge.

4. The yarn carrier as defined in claim 1 wherein said exterior surface of said tube is cylindrical.

5. The yarn carrier as defined in claim 4 wherein said tube is about 17 cm in length, said exterior surface of said tube is between about 6 to 7 cm in diameter, and said base surface is between about 1.5 to 1.8 cm in diameter.

6. The yarn carrier as defined in claim 5 wherein said extension has a length of about 1 cm, and the spacing between said parallel opposite sides of said extension is about 0.2 cm.

7. The yarn carrier as defined in claim 1 further comprising a second yarn catching means mounted on said exterior surface of said tube circumferentially spaced from said first mentioned yarn catching means by about 180°, and with said second yarn catching means being structurally substantially the same as said first mentioned yarn catching means.

8. The yarn carrier as defined in claim 1 wherein said tube and said yarn catching means are formed of integrally molded plastic.

* * * * *